US007428867B1

(12) United States Patent
Bell, Jr.

(10) Patent No.: US 7,428,867 B1
(45) Date of Patent: Sep. 30, 2008

(54) SELF-ENERGIZING GRIPPER FOR STRAPPING MACHINE

(75) Inventor: Lemuel J. Bell, Jr., Gurnee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/851,984

(22) Filed: Sep. 7, 2007

(51) Int. Cl.
*B65B 13/24* (2006.01)

(52) U.S. Cl. ..... 100/30; 100/32; 140/93.4

(58) Field of Classification Search ..... 100/8, 100/16, 20, 22, 23, 26, 29, 30, 32, 33 R, 33 PB; 53/589; 140/93.2, 93.4, 123.5
See application file for complete search history.

(56) References Cited

U.S. PATENT DOCUMENTS 3,442,734 A * 5/1969 Ericsson ..... 156/73.5
3,545,499 A * 12/1970 Dalton et al. ..... 140/93.2
6,401,764 B1 6/2002 Bell, Jr.
7,073,432 B2 * 7/2006 Marttila et al. ..... 100/32

* cited by examiner

*Primary Examiner*—Jimmy T Nguyen
(74) *Attorney, Agent, or Firm*—Mark W. Croll; Donald J. Breh; Levenfeld Pearlstein, LLC

(57) ABSTRACT

A self-energizing gripper is configured for use in a strapping machine that includes a rigid surface along which a strapping material traverses and against which the strapping material is clamped. The self-energizing gripper includes first and second links mounted at respective first ends to the strapping machine for pivotal movement and a gripping element pivotally mounted to respective second ends of each the first and second links. The gripping element includes a substantially planar gripping element surface. The first and second links are mounted to the gripping element for pivotal movement of the gripping element along an arcuate path toward and away from the rigid surface and the gripping element surface remains parallel as the gripping element moves along the arc between an open gripper position and a closed gripper position.

8 Claims, 4 Drawing Sheets

SELF-ENERGIZING GRIPPER FOR STRAPPING MACHINE

BACKGROUND OF THE INVENTION

This invention pertains to a gripper for a strapping machine. More particularly, this invention pertains to a gripper for use in the strapping head of a strapping machine for plastic strapping material.

Strapping machines are well-known in the art. There are two principle types of strapping machines, manual and automatic, table-top or free-standing machines. Strapping machines are typically designed for use with either plastic or metal (steel) strapping. These machines position, tension and seal strap around a load to bundle or secure the load.

A typical strapping machine includes a frame-like support for the overall machine, a working area to, for example, support a load, a feed head to feed strap around the load and to retract strap prior to tensioning, a chute through which the strap is fed around the load, a strapping head to secure the strap to itself and one or more dispensers for dispensing the strap material to the strapping head.

In a plastic strapping machine, the strapping head serves a number of functions. First, it clamps or grips a free end of the strap (end grip) as it returns to the strapping head. Next, it clamps or grips a trailing end of the strap following retraction and during tensioning of the strap (tension grip). Then, it grips the strap again (both courses of strap) on the opposite or inside of the strap loop (loop gripper), as it severs the sealed strap from the feed or dispenser side (to permit removing the strapped load from the machine) and seals the overlapping courses of strapping together.

One or more of the grippers may be of the self actuating type. That is, rather than relying on an applied (e.g., cylinder-provided) force, the movement of the strap urges a pivoting gripper element into greater (higher force) contact with the strap. These known self-energizing grippers use a single pivot, lobed element with an asymmetric curved gripping surface to capture the strap between the gripping surface and a clamping surface.

Although these self energizing grippers function well to secure the strap, there are drawbacks. First, because the gripper element pivot is close to the gripping surface, the gripper is sensitive to strap thickness. For example, a thicker strap will increase the contact angle such that the gripper may not properly self energize. This requires the pivot location (axis) to be adjusted for different strap gauges.

Moreover, because the gripping surface is curved, the area of contact between the gripper and the strap is small. This can result in the strap being deformed, which can affect refeeding the strap, as during a next strapping cycle.

Efforts to increase the contact area between the gripping surface and the strap include increasing the area of the clamping surface, as by forming a curve in the surface, however, it has been observed that such efforts show the same drawbacks as that of the conventional gripper, that is, sensitivity to strap thickness and strap deformation.

Accordingly, there exists a need for a self energizing gripper that is not adversely effected by variations in strap gauge. Desirably, such a self-energizing gripper will not fail to grip with an overly thick strap. More desirably, such a gripper does not rely on a small contact are to secure the strap. More desirably still, such a gripper does not deform the strap as it grips the strap.

BRIEF SUMMARY OF THE INVENTION

A self-energizing gripper is used in a strapping machine having a rigid surface along which a strapping material traverses and against which the strapping material is clamped. The gripper includes first and second links mounted at respective first ends to the strapping machine for pivotal movement and a gripping element pivotally mounted to respective second ends of each the first and second links. The gripping element includes a substantially planar gripping element surface.

The first and second links are mounted to the gripping element for pivotal movement of the gripping element along an arcuate path toward and away from the rigid surface. The gripping element surface remains parallel as the gripping element moves along the arc between an open gripper position and a closed gripper position.

The self energizing gripper is not adversely effected by variations in strap gauge and as such will not fail to grip an overly thick or overly thin strap. The gripper uses a relatively larger contact area to secure the strap. Because the gripper has a flat contact or gripper surface, it does not deform the strap as it grips the strap.

A present gripper includes a biasing element operably connected to the links to urge the gripping element to the closed gripper position. Preferably, the links are mounted parallel to one another and the gripping element surface is substantially planar. A cam element can be mounted to one of the links such that contact with the cam urges the gripping element to the open gripper position.

The parallelogram link arrangement is configured such that an axis of each of the links forms an angle with the rigid surface and movement of the gripping element along the arcuate path toward and away from the rigid surface is through an angle of less than 90 degrees and maintains that gripping element surface parallel to the rigid surface.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
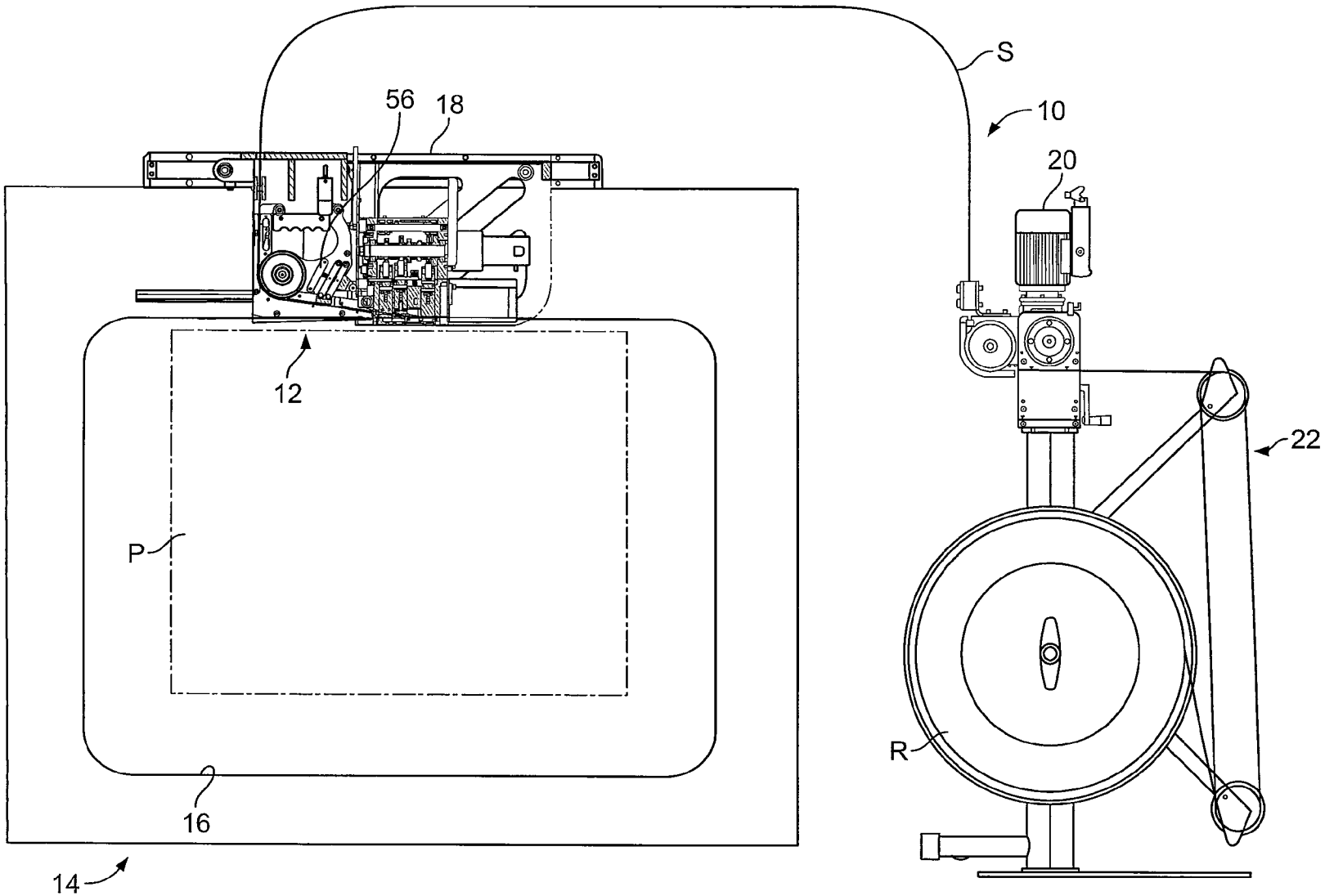
FIG. 1 is a front view of an overhead strapping machine having a self-energizing gripper embodying with the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1 there is illustrated a strapping machine 10 having a self-energizing gripper 12 embodying the principles of the present invention. The strapper 10 includes, generally, a frame 14, a strap chute 16, a sealing head or module 18, a feed or drive head (or module) 20 and a strap dispenser 22. As illustrated, the dispenser 22 and feed head 20 can be separately located (generally nearby), to facilitate maintenance on the dispenser 22 (e.g., reloading strap reels R) and the feed head 20 as needed. Packages P to be strapped are positioned within the chute 16. Packages can be of any size that fits within the chute 16.

The sealer module 18 has a number of grippers. For example, an end grip 24 clamps the free end F of the strap S as it returns to the strapping head 18. A tension grip 26 clamps the trailing end T of the strap following retraction and during tensioning of the strap, and a loop grip 28 clamps both courses of strap on the opposite or inside of the strap loop L, as the sealed strap loop L is severed from the feed or dispenser 22 side and the seal (sealing the overlapping courses of strapping together) is formed.

Some of the grippers are actuated by a mechanical or electro-mechanical element to exert the full force necessary to clamp the strap. For example, a cylinder or cam element 30 can exert a force on a gripper element (for example loop grip 28) that clamps down onto the strap S. Other grippers are of the self-energizing type in which the tension force of the strap S urges the gripper tighter.

Figure 2A:
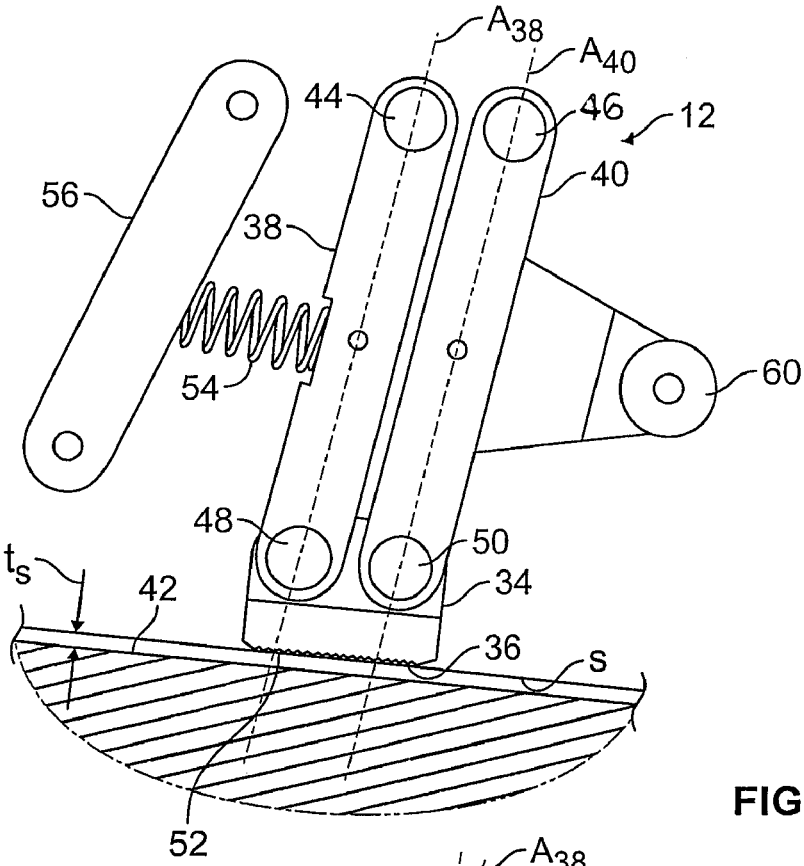
FIGS. 2A and 2B are an enlarged partial views of the self energizing gripper in the closed and open gripper states, respectively.
Figure 2B:
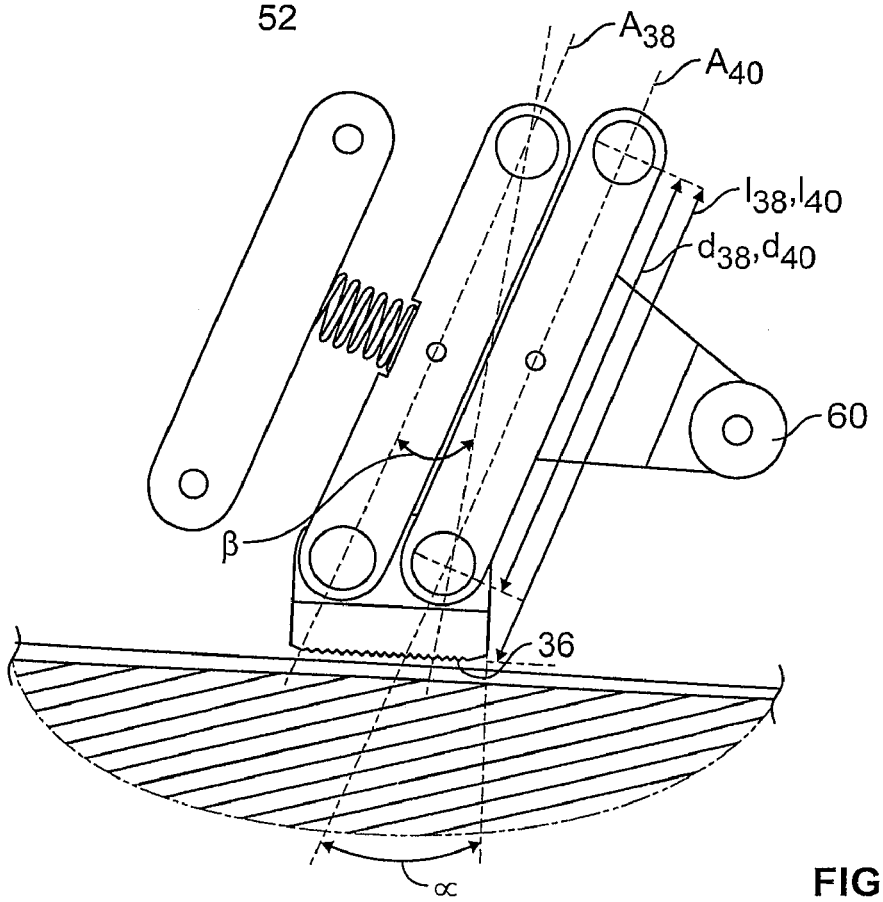

Referring to FIGS. 2A and 2B, the present self-energizing gripper 12 (shown in the closed and open states, respectively), uses a gripping element 34 that has a relatively large, flat or relatively flat gripping head surface 36. The element 34 is mounted by multiple (preferably two) pivot links 38, 40, for pivotal movement, into and out of engagement with the strap S, which is passed between the gripping element 34 and a platen or anvil 42. The platen 42 is a rigid, flat or substantially flat surface along which the strap S traverses toward the sealing head 18.

Figure 3:
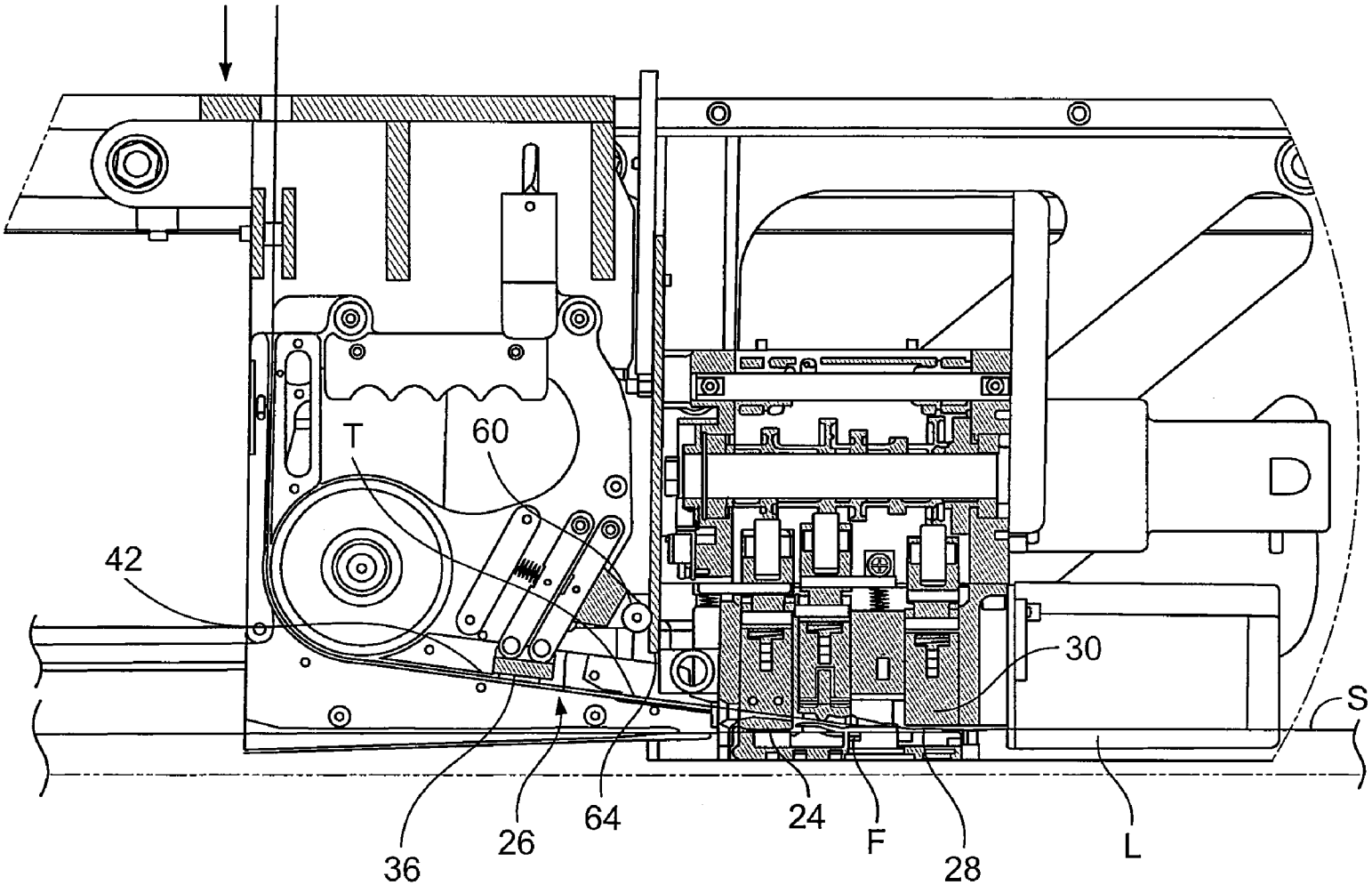
FIG. 3 is an illustration of the strapper showing the gripper in an open state.
Figure 4:
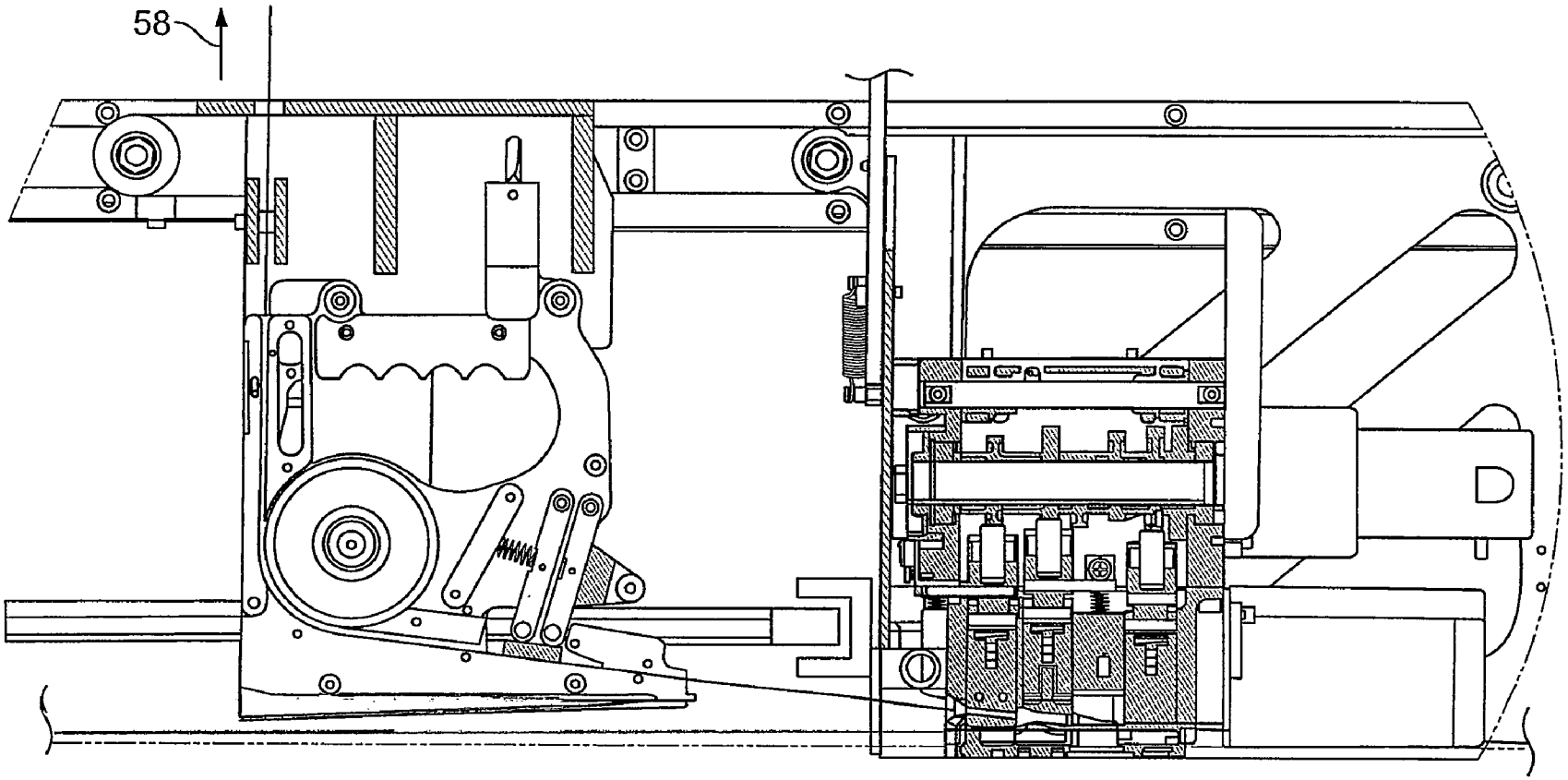
FIG. 4 is an illustration of the strapper showing the gripper in a closed state.

The pivot links 38, 40 are fixed (but mounted for pivotal movement) at respective pivot locations 44, 46 (to the strapper 10) and are pivotally mounted to the gripping element 34 at their opposite ends as indicated at 48, 50. The links 38, 40 are parallel (e.g., $A_{38}$ and $A_{40}$ are parallel) and equal length (e.g., $d_{38}$ and $d_{40}$ between respective pivots 44/48 and 46/50) and as such, although the gripping element 34 moves in a pivotal or arcuate motion, the gripping head surface 36 remains parallel to the platen 42 surface as the gripping element 34 moves or pivots between the open and closed gripper positions (FIGS. 3 and 4, respectively). This parallelogram link configuration provides means for mounting the element 34 to the strapping machine 10 such that the element 34 pivots into and out of contact with the strap S, but the contact surface 36 remains parallel to the strap S to maximize the contact area (indicated generally at 52). The angle $\alpha$ through which the links 38, 40 (and thus the element 34) pivot is acute, i.e., less than 90 degrees.

Because the gripping head surface 36 is flat or relatively flat, the contact area 52 between the gripping head surface 36 and the strap S is substantially larger than known single pivot grippers. Accordingly, there is less opportunity for the gripper 12 to deform the strap S when the gripping head surface 36 is in contact with the strap S. Moreover, the flat gripping head surface 36 is substantially less sensitive to variations in strap thickness or gauge $t_s$, in part because of the flat surface 36, but also because of the increased distance $d_{38}$, $d_{40}$ between the fixed pivot axes 44, 46 and the gripping head surface 36. This also provides a relatively large contact angle $\beta$. The present gripping head surface 36 is textured or roughened, as by forming a diamond-pattern in the surface 36.

The gripping element 34 is urged toward contact with the strap S by a biasing element, such as the illustrated coil spring 54. The spring 54 is intended to urge the gripping head element 34 into contact with the strap S, rather than to provide a substantial contact force between the gripping element 34 and the strap S. The spring 54 is mounted to the machine 10 at a location (indicated at 56) that is fixed relative to the moving gripper 12. The spring 54 contacts one of the links (an outboard link 38) on a side of the link 38 to urge the element 34 into contact with the strap S and platen 42.

In a present gripper 12, a release function for the gripper 12 is provided in two ways. First, by virtue of the pivot arrangement of the gripping element 34 and pivot links 38, 40, movement of the strap S opposite of the gripping direction (in a direction indicated by the arrow at 58) pivots the gripping element 34 away from the platen 42 which in turn "opens" the gripper 12 (FIG. 3). In addition, the opposite link (the inboard link 40) includes a cam element 60 mounted thereto. The cam 60 is disposed such that a force applied to the cam 60 (as indicated by the arrow at 62) will urge the element 34 (and the links 38, 40) to pivot to open the gripper 12. In both instances, movement of the gripping element 34 to open the gripper 12 is against the spring 54 force. Contact on and movement of the cam 60 can be effected by relative movement of the cam 60 and a release element, or movement of the strapping head and or tensioning assembly such that the cam 60 contacts a (relatively) fixed element (see surface 64 in FIG. 3) on the strapping machine 10.

In a typical strapping cycle, after the free end F of the strapping material S has been clamped in the end gripper 24 and tension is being pulled in the strap (by movement of the tension gripper 12 (assembly) away from the strapping head 18, while gripping the material, the force of the spring 54 urges the strap tension gripper 12 into contact with the strap S, and the tension (force) in the strap urges (pulls) the tension gripping element 34 toward the platen 42 (e.g., the gripper is self energizing). The greater the tensile force that is exerted on the strap S, the greater the force that "closes" the gripper 12. Once the cycle is complete and the tension gripper 12 is to be opened, contact between the tension gripper release cam 60 and the release element or other (relatively) fixed element 64 opens the gripper 12.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A self-energizing gripper for a strapping machine having a rigid surface along which a strapping material traverses and against which the strapping material is clamped, comprising:

first and second links mounted at separate first and second pivot locations by respective first ends to the strapping machine for pivotal movement, the first and second links are mounted parallel to one another and the links having equal length;

a gripping element pivotally mounted to respective second ends of each of the first and second links, the gripping element including a substantially planar gripping element surface, a biasing element operably connected to the first link to urge the gripping element to a closed gripper position; and a cam element mounted to the second link, wherein contact with the cam urges the gripping element to an open gripper position, wherein the first and second links are mounted to the gripping element for pivotal movement of the gripping element along an arcuate path toward and away from the rigid surface, and wherein the gripping element surface remains parallel to the rigid surface as the gripping element moves along an arc between the open gripper position and the closed gripper position.

2. The gripper in accordance with claim 1 wherein the biasing element is a spring.

3. The gripper in accordance with claim 1 wherein the gripping element surface is substantially planar.

4. The gripper in accordance with claim 1 wherein an axis of each of the links forms an angle with the rigid surface and wherein movement of the gripping element along the arcuate path toward and away from the rigid surface is through an angle of less than 90 degrees.

5. The gripper in accordance with claim 1 wherein the gripping element surface is parallel to the rigid surface.

6. The gripper in accordance with claim 1 wherein the gripping element surface is textured.

7. A self-energizing gripper for a strapping machine having a rigid surface along which a strapping material traverses and against which the strapping material is clamped, comprising:

a gripping element having a substantially planar gripping element surface;

means for mounting the gripping element to the strapping machine wherein the gripping element pivots relative to the strapping machine and wherein the gripping element surface remains parallel to the rigid surface as the gripping element pivots between an open gripper position and a closed gripper position;

wherein the means for mounting the gripping element is a parallelogram link and the parallelogram link includes a first and a second parallel equal length links, the first and second links operably mounted to the strapping machine at separate pivot locations and operably mounted to the gripping element for pivotal movement thereof;

the gripper further comprises a biasing element operably connected to the first link to urge the gripping element to the closed gripper position; and a cam element mounted to the second link, wherein contact with the cam urges the gripping element to the open gripper position.

8. The gripper in accordance with claim 7 wherein the gripping element surface is textured.

* * * * *